US010538994B2

(12) United States Patent
Rodriguez et al.

(10) Patent No.: US 10,538,994 B2
(45) Date of Patent: Jan. 21, 2020

(54) MODIFIED JUNCTION ISOLATION TOOL FOR MULTILATERAL WELL STIMULATION

(71) Applicant: HALLIBURTON ENERGY SERVICES, INC., Houston, TX (US)

(72) Inventors: Franklin Charles Rodriguez, Addison, TX (US); Homero De Jesus Maldonado, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 127 days.

(21) Appl. No.: 15/760,213

(22) PCT Filed: Dec. 10, 2015

(86) PCT No.: PCT/US2015/064994
§ 371 (c)(1),
(2) Date: Mar. 14, 2018

(87) PCT Pub. No.: WO2017/099777
PCT Pub. Date: Jun. 15, 2017

(65) Prior Publication Data
US 2019/0040719 A1 Feb. 7, 2019

(51) Int. Cl.
*E21B 43/14* (2006.01)
*E21B 43/26* (2006.01)
*E21B 23/03* (2006.01)
*E21B 41/00* (2006.01)

(52) U.S. Cl.
CPC ..... *E21B 41/0042* (2013.01); *E21B 43/14* (2013.01)

(58) Field of Classification Search
CPC ..... E21B 43/14; E21B 43/30; E21B 43/305; E21B 43/26; E21B 41/0035; E21B 41/0042; E21B 23/002; E21B 23/03
USPC ..... 166/50
See application file for complete search history.

(56) References Cited

U.S. PATENT DOCUMENTS 5,322,127 A 6/1994 McNair et al.
5,526,880 A * 6/1996 Jordan, Jr. ..... E21B 33/16 166/291
5,564,503 A * 10/1996 Longbottom ..... E21B 7/061 166/313
5,715,891 A * 2/1998 Graham ..... E21B 7/061 166/313

(Continued)

OTHER PUBLICATIONS

ISR/WO for PCT/US2015/064994 dated Aug. 19, 2016.

*Primary Examiner* — Kenneth L Thompson
(74) *Attorney, Agent, or Firm* — Scott Richardson; C. Tumey Law Group PLLC

(57) ABSTRACT

A method includes conveying a junction isolation tool, a junction support tool, a lateral completion assembly, and a completion deflector into a parent wellbore lined with casing. The completion deflector is coupled to the casing and the lateral completion assembly is detached and advanced into a lateral wellbore. After fracturing the lateral wellbore, the junction isolation tool is detached from the junction support tool, retracted back into the parent wellbore, and coupled to the completion deflector by advancing a stinger into an inner bore of the completion deflector. After hydraulically fracturing a lower wellbore portion of the parent wellbore, the junction isolation tool removes the completion deflector from the parent wellbore.

20 Claims, 9 Drawing Sheets

(56) References Cited

U.S. PATENT DOCUMENTS

| | | | | |
|---|---|---|---|---|
| 5,735,350 | A | 4/1998 | Longbottom et al. | |
| 6,009,949 | A * | 1/2000 | Gano | E21B 41/0042 166/313 |
| 6,019,173 | A * | 2/2000 | Saurer | E21B 7/061 166/117.6 |
| 6,053,254 | A | 4/2000 | Gano | |
| 6,209,644 | B1 | 4/2001 | Brunet | |
| 6,668,932 | B2 | 12/2003 | Hess et al. | |
| 7,487,835 | B2 * | 2/2009 | Carter, Jr. | E21B 41/0035 166/298 |
| 8,794,328 | B2 | 8/2014 | Benson et al. | |
| 9,506,325 | B2 * | 11/2016 | Fould | E21B 43/14 |
| 2010/0314109 | A1 * | 12/2010 | Garcia | E21B 41/0035 166/278 |
| 2013/0327572 | A1 | 12/2013 | Sponchia et al. | |
| 2016/0145956 | A1 * | 5/2016 | Dahl | E21B 7/061 166/382 |

* cited by examiner

MODIFIED JUNCTION ISOLATION TOOL FOR MULTILATERAL WELL STIMULATION

The present application is a U.S. National Phase entry under 35 U.S.C. § 371 of International Application No. PCT/US2015/64994, filed on Dec. 10, 2015, the entirety of which is incorporated herein by reference.

BACKGROUND

Multilateral well technology allows an operator to drill a parent wellbore, and subsequently drill a lateral wellbore that extends from the parent wellbore at a desired orientation and to a chosen depth. Generally, to drill a multilateral well, the parent wellbore is first drilled and then at least partially lined with a string of casing. The casing is subsequently cemented into the wellbore by circulating a cement slurry into the annular region formed between the casing and the surrounding wellbore wall. The combination of cement and casing strengthens the parent wellbore and facilitates the isolation of certain areas of the formation behind the casing for the production of hydrocarbons to an above ground location at the earth's surface where hydrocarbon production equipment is located.

To connect the parent wellbore to a lateral wellbore a casing exit (alternately referred to as a "window") is created in the casing of the parent wellbore. The window can be formed by positioning a whipstock at a predetermined location in the parent wellbore. The whipstock is then used to deflect one or more mills laterally relative to the casing string and thereby penetrate part of the casing to form the window. A drill bit can be subsequently inserted through the window in order to drill the lateral wellbore to a desired depth, and the lateral wellbore can then be completed as desired.

Part of the completion process for the lateral wellbore often includes a hydraulic fracturing operation to help enhance hydrocarbon recovery from formations surrounding the lateral wellbore. One method to fracture the lateral wellbore includes running and deflecting a completion assembly into the lateral wellbore, securing the completion assembly in the lateral wellbore, and opening one or more sliding sleeves to expose flow ports that provide fluid communication between the completion assembly and the surrounding formation. A fluid is then injected under pressure into the surrounding formation via the exposed flow ports to hydraulically fracture the formation and thereby create a fluid-porous network in the formation whereby hydrocarbons can be extracted.

Currently, hydraulic fracturing operations in multilateral wells could require as many as eighteen separate runs into the well, plus any additional runs required to perform conventional plug and perforation operations. As can be appreciated, reducing the number of trips into the well can save a significant amount of time and expense.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to completing wellbores in the oil and gas industry and, more particularly, to a running and retrieving junction isolation tool used for fracturing operations in multilateral wells.

The embodiments described herein may improve the efficiency of drilling and completing multilateral wellbores, and thereby improve or maximize production from the well. More specifically, the embodiments disclosed herein describe the installation of a junction support tool that spans the junction between a parent wellbore and a lateral wellbore of a multilateral well. A modified junction isolation tool is used to convey the junction support tool and a completion deflector into the well. The junction support tool and the junction isolation tool cooperatively operate to seal the lateral wellbore and isolate the parent wellbore. The deployed system may provide the proper environment for hydraulic fracturing operations of both parent and lateral wellbores. The junction isolation tool subsequently detaches from the junction support tool and is configured to retrieve the completion deflector. Notably, all of these operations can be done in one run into the well with the currently described embodiments, which drastically reduces the number of required trips into the well for conventional hydraulic fracturing operations in multilateral wells. Consequently, the embodiments described herein offer significant savings on tripping time and costs of well operation.

Figure 1:
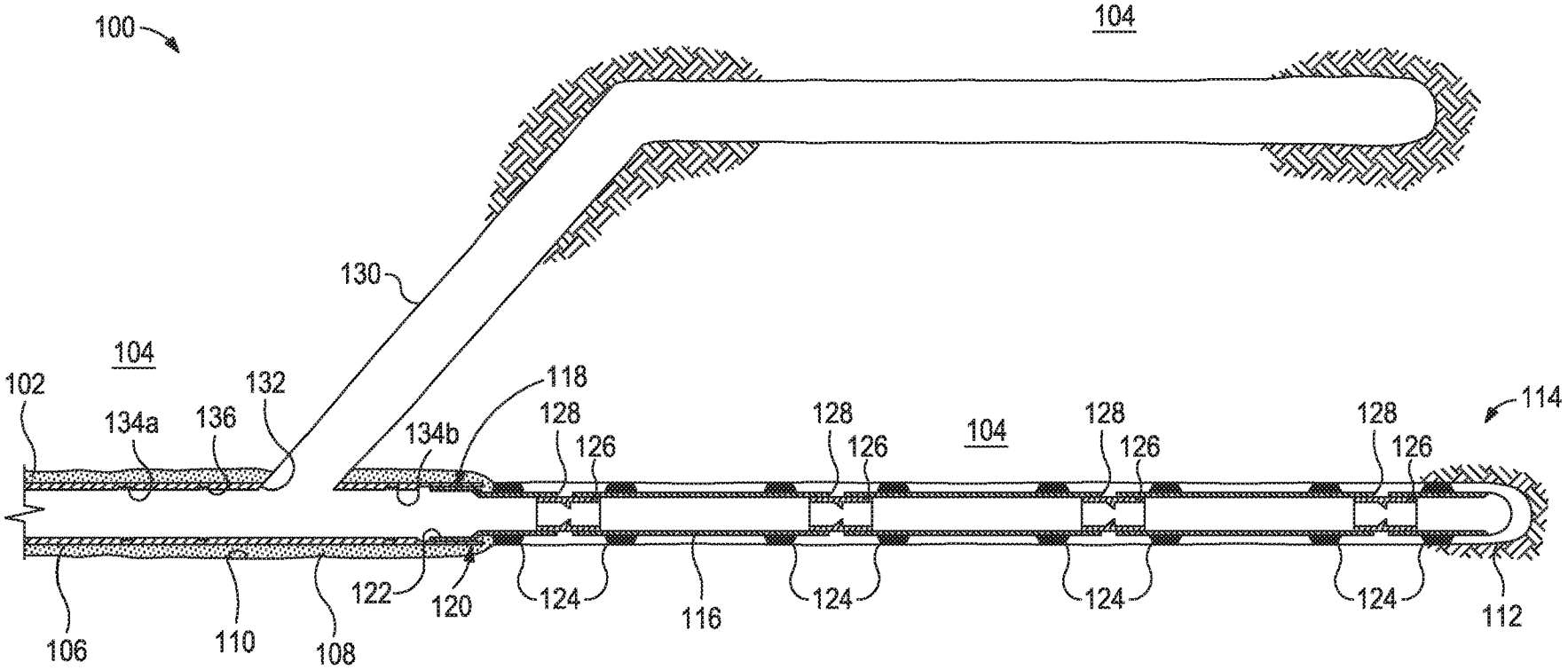
FIG. 1, illustrated is a cross-sectional side view of a well system that may employ from the principles of the present disclosure.

FIG. 1 is a cross-sectional side view of an exemplary well system 100 that may employ the principles of the present disclosure. As illustrated, the well system 100 may include a parent wellbore 102 that is drilled though various subterranean formations, including a hydrocarbon-bearing formation 104. Following drilling operations, the parent wellbore 102 may be completed by lining all or a portion of the parent wellbore 102 with casing 106. The casing 106 may extend from a surface location (i.e., where a drilling rig and related drilling equipment are located) or from an intermediate point between the surface location and the formation 104. All or a portion of the casing 106 may be secured within the parent wellbore 102 with cement 108 deposited in the annulus 110 defined between the casing 106 and the inner wall of the parent wellbore 102.

At some point after drilling and completing the parent wellbore 102, the depth of the parent wellbore 102 may be extended by drilling a lower wellbore portion 112. A lower completion assembly 114 may then be extended into the lower wellbore portion 112 in preparation for producing hydrocarbons from the formation 104 penetrated by the lower wellbore portion 112. As illustrated, the lower completion assembly 114 may include a liner 116 that may be secured to or otherwise "hung off" the casing 106 such that the lower completion assembly 114 extends into the lower wellbore portion 112. More particularly, the liner 116 may include a liner hanger 118 configured to be coupled to a distal end 120 of the casing 106. The liner hanger 118 may include various seals or packers (not shown) configured to seal against the inner wall of the casing 106 and thereby provide a sealed interface that effectively extends the axial length of the casing 106 into the lower wellbore portion 112. Moreover, the liner hanger 118 may further provide and otherwise define an inner polished bore receptacle 122 defined on its inner surface.

The lower completion assembly 114 may also include various downhole tools and devices used to prepare the lower wellbore portion 112 and subsequently extract hydrocarbons from the surrounding formation 104. For example, the lower completion assembly 114 may include a plurality of wellbore isolation devices 124 (alternately referred to as "packers") that isolate various production zones in the lower wellbore portion 112. More particularly, each production zone includes upper and lower wellbore isolation devices 124 configured to seal against the inner wall of the lower wellbore portion 112 and thereby provide fluid isolation between axially adjacent production zones. It will be appreciated that the lower completion assembly 114 is not necessarily drawn to scale in FIG. 1. Rather, there may be more or less production zones provided along the length of the liner 116, or the production zones in the lower completion assembly 114 could instead be axially spaced from each other by larger distances.

Each production zone may further include a sliding sleeve 126 positioned within the liner 116 and axially movable between closed and open positions to occlude or expose one or more flow ports 128 defined through the liner 116. When in the closed position, as shown in FIG. 1, the sliding sleeve 126 occludes the corresponding flow ports 128 and fluid communication between the interior of the liner 116 and the surrounding formation 104 is substantially prevented. When moved to the open position, as will be described below, the flow ports 128 become exposed and fluid communication between the interior of the liner 116 and the surrounding formation 104 is facilitated either for injection or production operations.

The well system 100 may further include a lateral wellbore 130 that extends from the parent wellbore 102. More particularly, at some point after or while drilling and completing the parent wellbore 102, a casing exit 132 (alternately referred to as a "casing window" or a "window") may be milled through the casing 106 at a desired location where the lateral wellbore 130 is to be formed. Such a location is often referred to as a "junction" between the parent and lateral wellbores 102, 130. Conventional wellbore drilling techniques and equipment may then be used to drill the lateral wellbore 130 a desired depth.

The casing 106 may include and otherwise provide on its inner wall an upper latch profile 134*a*, a lower latch profile 134*b*, and a latch anchor 136. The upper and lower latch profiles 134*a,b* may be positioned on opposing axial ends of the casing exit 126, and at least the lower latch profile 134*b* may have been used to help form the lateral wellbore 130. Each of the upper and lower latch profiles 134*a,b* and the latch anchor 136 may provide and otherwise define a unique profile pattern configured to selectively mate with a corresponding latch or anchor coupling, respectively. As described herein, the upper and lower latch profiles 134*a,b* and the latch anchor 136 may be used to help orient and secure various pieces of downhole equipment within the parent and lateral wellbores 102, 130 to hydraulically fracture and subsequently produce hydrocarbons from the surrounding formation 104.

Figure 2A:
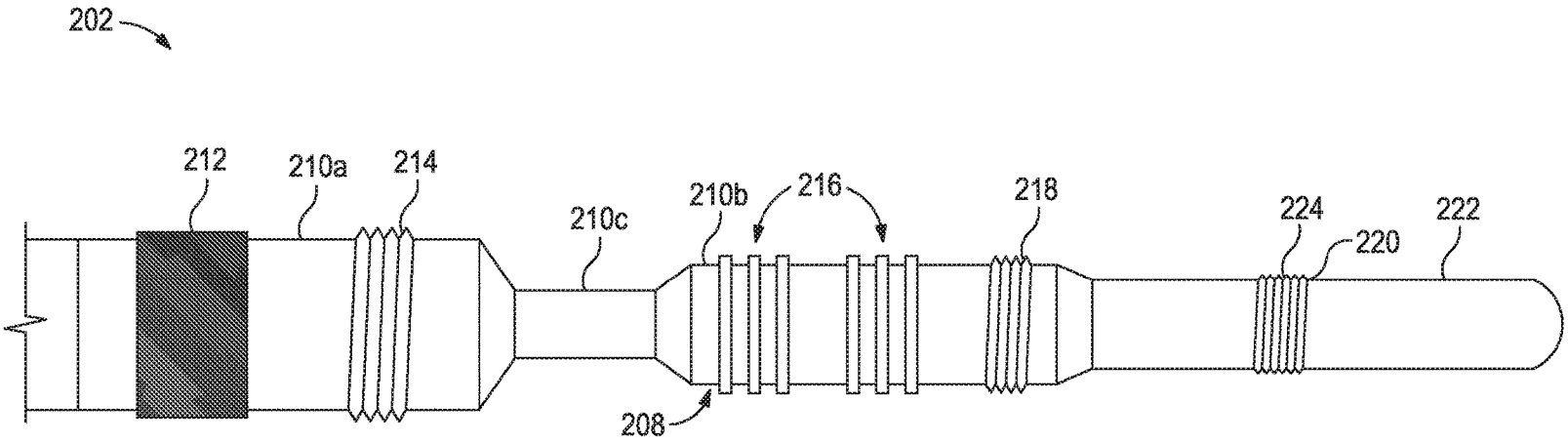
FIGS. 2A-2C are views of downhole equipment that may be introduced into the well system of FIG. 1 and used to help hydraulically fracture the surrounding formation.
Figure 2B:
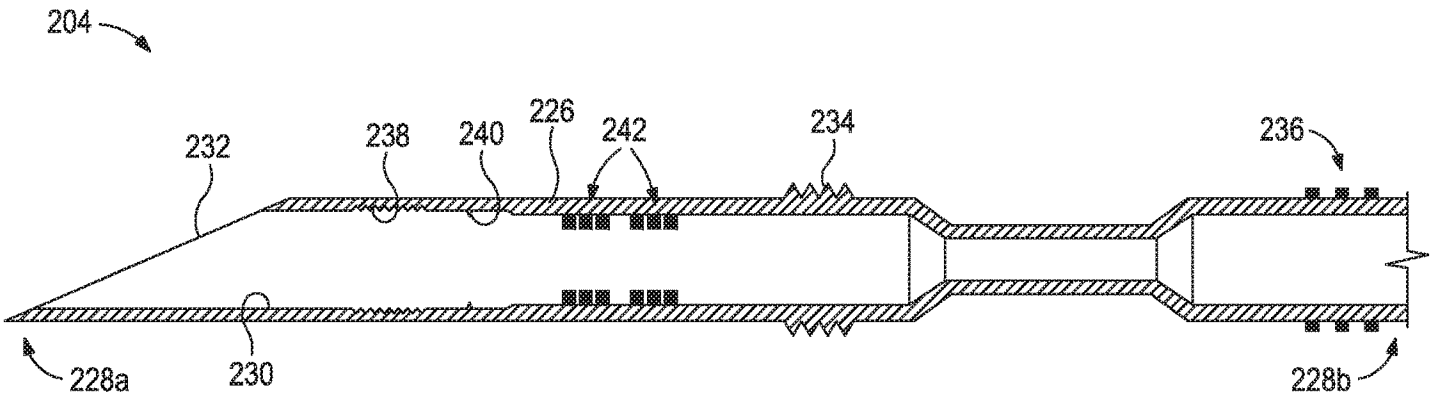
Figure 2C:
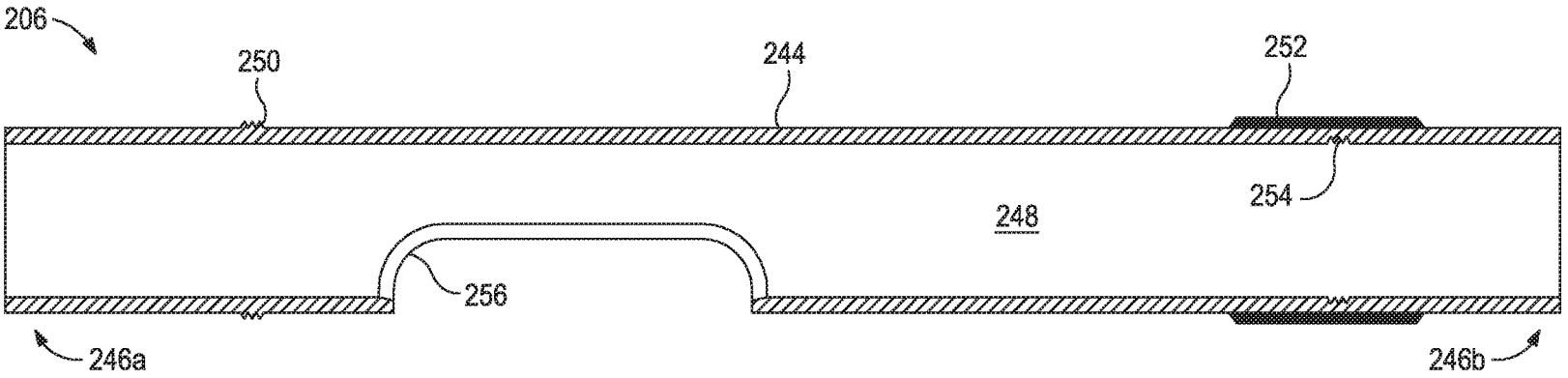

FIGS. 2A-2C are views of downhole equipment that may be introduced into the well system 100 of FIG. 1 and used to help hydraulically fracture the surrounding formation 104, according to one or more embodiments. More particularly, FIG. 2A is a side view of an exemplary junction isolation tool 202, FIG. 2B is a cross-sectional side view of an exemplary completion deflector 204, and FIG. 2C is a cross-sectional side view of an exemplary junction support tool 206 The junction isolation tool 202 may be configured to convey the completion deflector 204 and the junction support tool 206 into the parent wellbore 102 (FIG. 1) and to the junction between the parent and lateral wellbores 102, 130. As described below, the completion deflector 204 may be secured within the parent wellbore 102 and simultaneously stung into the lower completion 114. The completion deflector 204 may be configured to deflect the junction support tool 206 into the lateral wellbore 130 to be secured within both the parent and lateral wellbores 102, 130 and thereby provide a transition therebetween. After hydraulically fracturing one or both of the parent and lateral wellbores 102, 130, the junction isolation tool 202 may then be used to retrieve the completion deflector 204. Notably, the foregoing operations may all occur in one trip into the parent wellbore 102.

As illustrated in FIG. 2A, the junction isolation tool 202 may include an elongate body 208 that provides an upper sub 210*a*, a lower sub 210*b*, and a transition sub 210*c* that interposes the upper and lower subs 210*a,b*. The upper sub 210*a* may include a retrievable packer 212 and an upper latch coupling 214. The retrievable packer 212 may be disposed about the upper sub 210*a* at or near the upper end of the body 208 and may comprise an elastomeric material. Upon actuation (e.g., mechanically, hydraulically, etc.), the elastomeric material may radially expand into sealing engagement with the inner wall of a conduit or tubing, such as the inner wall of the casing 106 (FIG. 1), as described below. The upper latch coupling 214 may include one or more spring-loaded keys that exhibit a unique profile or pattern configured to locate and mate with the upper latch profile 134*a* (FIG. 1) provided on the inner surface of the casing 106.

The lower sub 210*b* includes one or more radial seals 216 (two sets shown) and a releasable connection 218. While two sets of radial seals 216 are shown, it will be appreciated that more or less radial seals 216 might be employed, without departing from the scope of the disclosure. The radial seals 216 may be configured to sealingly engage an inner radial surface of the junction support tool 206 (FIG. 2C), and thereby provide fluid isolation within the lateral wellbore 130 (FIG. 1). The radial seals 216 may include, but are not limited to, metal-to-metal seals, elastomeric seals (e.g., O-rings or the like), crimp seals, and any combination thereof. The releasable connection 218 may be configured to locate and be coupled to a profile 254 (FIG. 2C) provided on the inner radial surface of the junction support tool 206 (FIG. 2C). The releasable connection 218 allows the junction isolation tool 202 to be coupled to and subsequently separated from the junction support tool 206. Accordingly, the releasable connection 218 may comprise any connection mechanism or device that can be repeatedly locked and released as desired such as, but not limited to, a collet or a latching profile.

A stinger 222 may extend axially from the downhole end of the lower sub 210*b* and a stinger coupling 224 may be provided about the outer surface of the stinger 222. The stinger coupling 224 may include a radial shoulder 220 and, in some embodiments, may be provided at or adjacent the releasable connection 218. In other embodiments, as illustrated, the axial location of the stinger coupling 224 with respect to the releasable connection 218 may vary, such as being located at any intermediate location between the releasable connection 218 and the end of the stinger 222. As described below, the stinger 222 may be configured to be inserted into and sealingly engage an inner bore 230 (FIG. 2B) of the completion deflector 204 (FIG. 2B). Moreover, the stinger coupling 224 may be configured to locate and engage an inner latch 238 (FIG. 2B) defined and otherwise provided in the inner bore 230 of the completion deflector 204. Similar to the releasable connection 218, the stinger coupling 224 and associated inner latch 238 may comprise any connection mechanism or device that can be repeatedly locked and released including, but not limited to, a collet or a latching profile. One suitable connection mechanism or device that the stinger coupling 224 and associated inner latch 238 may entail is the RATCH-LATCH® device available from Halliburton Energy Services of Houston, Tex., USA.

The completion deflector 204 shown in FIG. 2B includes an elongate body 226 having a first or "upper" end 228*a*, a second or "lower" end 228*b*, and an inner bore 230 that extends longitudinally between the first and second ends 228*a,b*. A deflector face 232 may be provided and otherwise defined at the first end 228*a*. The deflector face 232 may comprise an angled surface used to deflect downhole tools into the lateral wellbore 130 (FIG. 1), such as the junction isolation tool 202 (FIG. 2A) and the junction support tool 206 (FIG. 2C). A lower latch coupling 234 may be positioned on the body 226 between the first and second ends 228*a,b*. The lower latch coupling 234 may include one or more spring-loaded keys that exhibit a unique profile or pattern configured to locate and mate with the lower latch profile 134*b* (FIG. 1) provided on the inner surface of the casing 106 (FIG. 1).

One or more radial seals 236 may be arranged about the exterior of the body 226 at or near the second end 228*b*. As described below, the second end 228*b* may be configured to be inserted or "stung" into the liner 116 (FIG. 1) of the completion assembly 114 (FIG. 1), and the radial seals 236 may sealingly engage the polished bore receptacle 122 (FIG. 1) defined on the inner surface of the liner 116. In another embodiment, however, the radial seals 236 may alternatively be included on the inner surface of the liner 116, and the outer surface of the body 226 at the second end 228*b* may instead act as a polished bore sealing surface, without departing from the scope of the disclosure.

An inner latch 238, a shearable shoulder 240, and one or more inner seals 242 may each be provided and otherwise defined within the inner bore 230. As discussed above, the inner latch 238 may be sized and configured to receive the stinger coupling 224 (FIG. 2A) of the junction isolation tool 202 (FIG. 2A). The shearable shoulder 240 may be an optional component of the completion deflector 204 and comprise any type of shearable mechanism or device configured to fail upon assuming a predetermined axial load. The shearable shoulder 240 may include, for example, a shear ring or one or more shear pins or shear screws. When included in the completion deflector 204, the shearable shoulder 240 may be sized to engage the radial shoulder 220 (FIG. 2A) as the stinger 222 (FIG. 2A) is extended axially into the inner bore 230. Upon assuming the predetermined axial load, as applied through the junction isolation tool 202, the shearable shoulder 240 may fail and allow the stinger coupling 224 to locate and engage the inner latch 238.

The inner seals 242 may be configured to sealingly engage the outer radial surface of the stinger 222 (FIG. 2A) as the junction isolation tool 202 (FIG. 2A) is extended axially into the completion deflector 204. In another embodiment, however, the inner seals 242 may alternatively be included on the outer radial surface of the stinger 222, and the inner surface of the inner bore 230 may instead be configured to receive the inner seals 242 and otherwise act as a polished bore receptacle, without departing from the scope of the disclosure.

The junction support tool 206 depicted in FIG. 2C may include an elongate body 244 having a first or "upper" end 246*a*, a second or "lower" end 246*b*, and an interior 248 extending between the first and second ends 246*a,b*. An anchor coupling 250 and a transition joint packer 252 may each be provided or otherwise defined on the outer surface of the body 244. The anchor coupling 250 may be provided at or near the upper end 246*a* and configured to locate and engage the latch anchor 136 (FIG. 1) provided on the casing 106 (FIG. 1) as the junction support tool 206 is advanced into the lateral wellbore 130 (FIG. 1). Similar to other couplings described herein, in some embodiments, the anchor coupling 250 may include one or more spring-loaded keys that exhibit a unique profile or pattern configured to locate and mate with the latch anchor 136. In other embodiments, however, the anchor coupling 250 may alternatively include a collet or a latching profile, without departing from the scope of the disclosure.

The transition joint packer 252 may be disposed about the body 244 at or near the lower end 246*b* and may comprise an elastomeric material. Upon actuation, the elastomeric material may radially expand into sealing engagement with the inner wall of the lateral wellbore 130 (FIG. 1). In some embodiments, the transition joint packer 252 may be made of a swellable material. In such embodiments, actuation of the transition joint packer 252 may include exposing the swellable elastomeric material to a downhole environment, such as an increased pressure or temperature, or exposing the swellable elastomeric material to a fluid, such as water, oil, or a chemical configured to react with and swell the elastomer. In other embodiments, however, the transition joint packer 252 may be actuated mechanically, hydraulically, or a combination thereof.

A profile 254 may be defined and otherwise provided on the inner radial surface of the interior 248. As noted above, the releasable connection 218 of the junction isolation tool 202 (FIG. 2A) may be configured to locate and couple to the profile 254 and thereby couple the junction isolation tool 202 to the junction support tool 206 such that movement of the junction isolation tool 202 within the well system 100 (FIG. 1) correspondingly moves the junction support tool 206.

The body 244 may further define an opening or "window" 256 at an intermediate location between the upper and lower ends 246*a,b*. As described herein, the window 256 may provide an opening that allows the junction isolation tool 202 (FIG. 2A) to extend into the completion deflector 204 (FIG. 2B) once detached from the junction support tool 206 and while the junction support tool 206 is secured within both the parent and lateral wellbores 102, 130 (FIG. 1). The window 256 may also prove advantageous in facilitating fluid communication from the lower wellbore portion 112 (FIG. 1) into the parent wellbore 102 while the junction support tool 206 is secured within both the parent and lateral wellbores 102, 130.

FIGS. 3-9 are cross-sectional side views of the well system 100 of FIG. 1 showing the sequential progression in completing the lateral wellbore 130 and subsequent production operations of the parent and lateral wellbores 102, 130 facilitated by the above-described junction isolation tool 202, completion deflector 204, and junction support tool 206. Similar numbers used in FIGS. 3-9 that are previously used in any of FIGS. 1 and 2A-2C refer to similar elements or components that may not be described again in detail.

Figure 3:
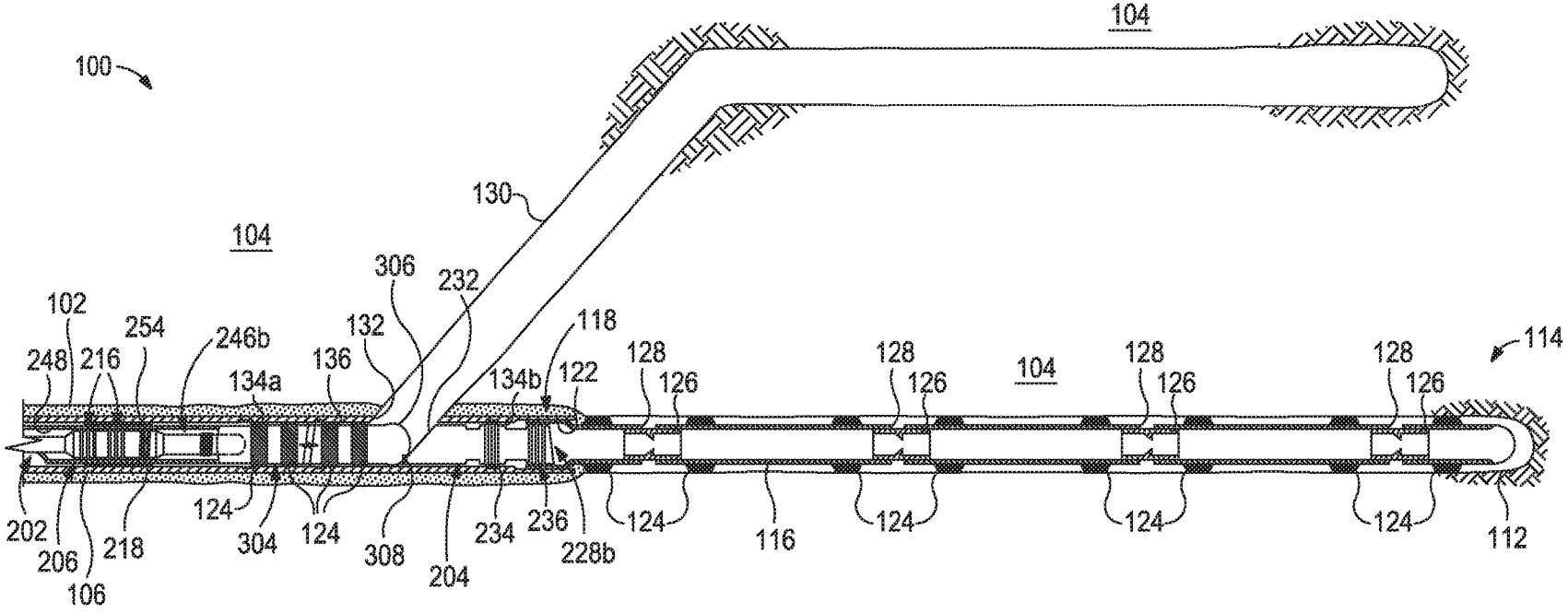
FIG. 3 depicts a cross-sectional side view of the well system of FIG. 1 deploying various downhole tools into the parent wellbore.

FIG. 3 shows a portion of the junction isolation tool 202 being used to convey the completion deflector 204 and the junction support tool 206 into the parent wellbore 102. More particularly, the uphole end of the junction isolation tool 202 may be operatively coupled to a conveyance 302 (FIG. 4) extended from a surface location (not shown), such as a drilling rig, a subsea platform, or a floating barge or platform. The conveyance 302 may include, but is not limited to, production tubing, drill pipe, coiled tubing, or any string of rigid tubular members. As illustrated, the junction isolation tool 202 is coupled to the junction support tool 206 by extending longitudinally into the interior 248 of the junction support tool 206 and having the releasable connection 218 locate and engage the profile 254 of the junction support tool 206. Moreover, as the junction isolation tool 202 extends longitudinally into the interior 248 of the junction support tool 206, the radial seals 216 of the junction isolation tool 202 may sealingly engage the inner radial surface of the junction support tool 206.

The junction isolation tool 202 may also be used to convey a lateral completion assembly 304 into the parent wellbore 102 and, as described below, ultimately into the lateral wellbore 130. More specifically, the lateral completion assembly 304 may be coupled to the lower end 246*b* of the junction support tool 206 and may otherwise axially interpose the junction isolation tool 202 and the completion deflector 204 as the completion deflector 204 is advanced downhole. For space constraints, the lower completion assembly 304 is shown in FIG. 3 as minimized by having a large portion excised from its middle section. A bullnose 306 may be provided at the downhole end of the lateral completion assembly 304 and may be coupled to the completion deflector 204 using a release mechanism 308. In some embodiments, the release mechanism 308 may comprise a shear bolt or other type of shearable device. In other embodiments, however, the release mechanism 308 may comprise any suitable coupling mechanism, such as a release device that operates mechanically, electromechanically, hydraulically, etc. Accordingly, movement of the junction isolation tool 202 within the well system 100 correspondingly moves the junction support tool 206, the lateral completion assembly 304, and the completion deflector 204, as all are operatively coupled (either directly or indirectly) to the junction isolation tool 202.

The release mechanism 308 provides the required force and torque resistance to advance the completion deflector 204 within the parent wellbore 102 to be coupled to the casing 106 near the casing exit 132. The completion deflector 204 is advanced until the lower latch coupling 234 locates and engages the lower latch profile 134*b* provided on the casing 106. The second end 228*b* of the completion deflector 204 may be stung into and otherwise received by the proximal end of the liner 116 and, more particularly, the liner hanger 118. As the second end 228*b* enters the liner 116, the radial seals 236 of the completion deflector 204 may be configured to sealingly engage the polished bore receptacle 122 defined on the inner surface of the liner 116.

With the lower latch coupling 234 secured to the lower latch profile 134*b*, the release mechanism 308 may be detached. In embodiments where the release mechanism 308 is a shear bolt, for example, an axial load in the form of weight may be applied in increments to the junction isolation tool 202 to shear the release mechanism 308 and thereby separate the bullnose 306 from the completion deflector 204. The weight applied to the junction isolation tool 202 may originate from the surface location and be transferred to the release mechanism 308 via the conveyance 302 (FIG. 4) and through the operative connection of the junction isolation tool 202, the junction support tool 206, the lateral completion assembly 304, and the bullnose 306. Once the release mechanism 308 fails, the lateral completion assembly 304, and the coupled junction isolation tool 204 and the junction support tool 206, may be free to move with respect to the completion deflector 204. Once free, the completion assembly 304 may be advanced into the lateral wellbore 130 by engaging the bullnose 306 against the deflector face 232, which deflects the completion assembly 304 into the lateral wellbore 130 via the casing exit 132.

Figure 4:
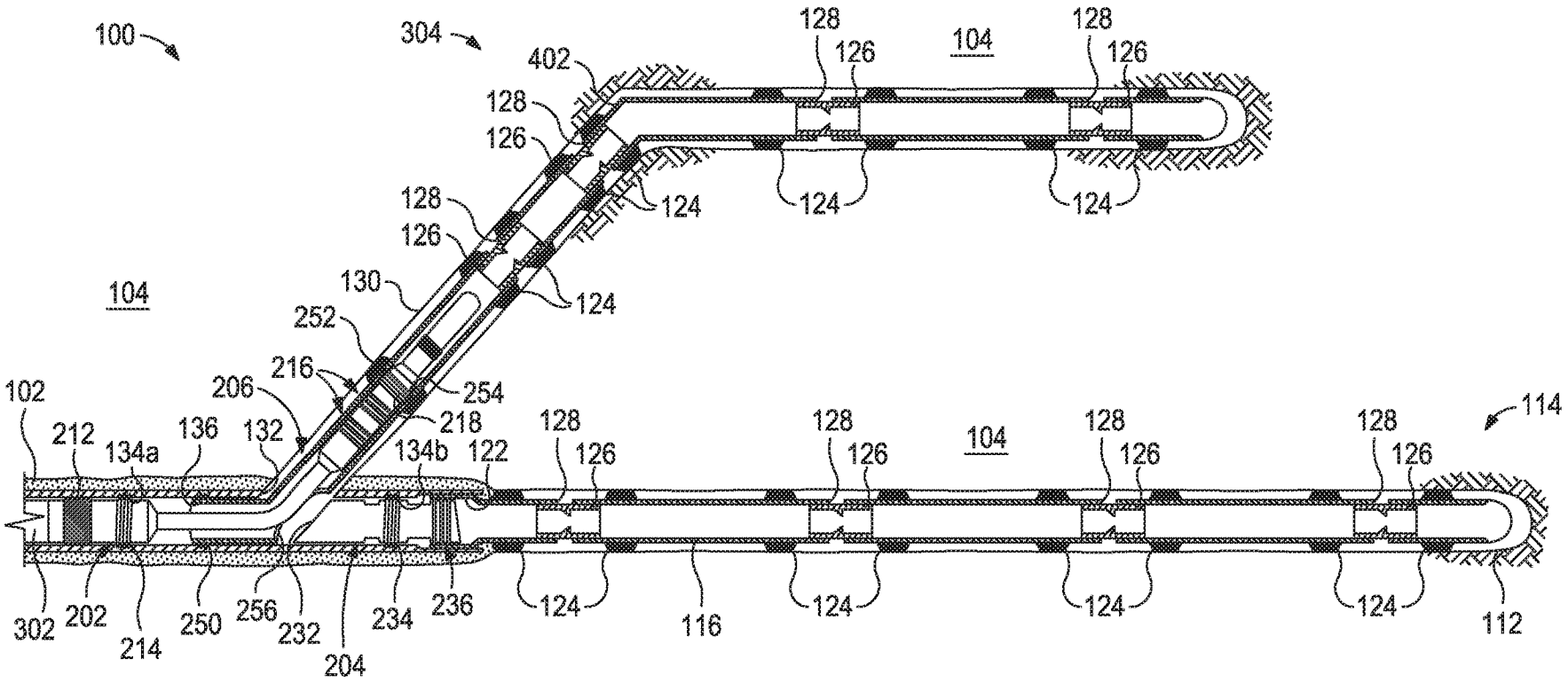
FIG. 4 is a cross-sectional side view of the well system and the lateral completion assembly of FIG. 3 advanced and positioned within the lateral wellbore.

FIG. 4 shows a cross-sectional side view of the well system 100 with the lateral completion assembly 304 advanced and positioned within the lateral wellbore 130. As illustrated, portions of both the junction isolation tool 202 and the junction support tool 206 may also advance into the lateral wellbore 130 to position the lateral completion assembly 304 at depth within the lateral wellbore 130. Specifically, the junction support tool 206 may be configured to span the junction between the parent and lateral wellbores 102, 130 at the casing exit 132, and thereby provide a structural transition member that extends therebetween. The lateral completion assembly 304 may be advanced into the lateral wellbore 130 until the upper latch coupling 214 of the junction isolation tool 202 locates and engages the upper latch profile 134*a* provided on the inner surface of the casing 106. Engagement between the upper latch coupling 214 and the upper latch profile 134*a* may help radially and axially support the junction isolation tool 202 within the parent wellbore 102 and as extended partially into the lateral wellbore 130.

Engagement between the upper latch coupling 214 and the upper latch profile 134*a* may also be configured to rotationally orient the junction support tool 206 such that the window 256 is aligned with the completion deflector 204 and, therefore, opens toward the deflector face 232. Once proper alignment of the window 256 with respect to the completion deflector 204 is confirmed by coupling the upper latch coupling 214 to the upper latch profile 134*a*, the junction support tool 206 may be anchored to the casing 106 by locating and engaging the anchor coupling 250 to the latch anchor 136. In some embodiments, the anchor coupling 250 may be secured to the latch anchor 136 at the same time the upper latch coupling 214 is secured to the upper latch profile 134*a*. In other embodiments, however, the upper latch coupling 214 may be secured to the upper latch profile 134*a* first and subsequent axial movement of the junction support tool 206 may allow the anchor coupling 250 to be secured to the latch anchor 136. Proper coupling between the anchor coupling 250 and the latch anchor 136 may secure the junction support tool 206 against axial and/or rotational movement within both the parent and lateral wellbores 102, 130.

As illustrated in FIG. 4, the lateral completion assembly 304 may be similar in some respects to the lower completion assembly 114. For example, the lateral completion assembly 304 may include a liner or base pipe 402 extended into the lateral wellbore 130, where the upper end of the base pipe 402 is coupled to the lower end 246*b* of the junction support tool 206. The lateral completion assembly 304 may also include a plurality of wellbore isolation devices 124 used to isolate various production zones in the lateral wellbore 130. Each production zone includes upper and lower wellbore isolation devices 124 configured to seal against the inner wall of the lateral wellbore 130 and thereby provide fluid isolation between axially adjacent production zones. As with the lower completion assembly 114, the lateral completion assembly 304 is not necessarily drawn to scale in FIG. 4. Rather, there may be more or less production zones provided along the length of the base pipe 402, or the production zones in the lateral completion assembly 304 could instead be axially spaced from each other by larger distances.

Similar to the lower completion assembly 114, the lateral completion assembly 304 may further include a sliding sleeve 126 positioned within the base pipe 402 and axially movable between closed and open positions to occlude or expose one or more flow ports 128 defined through the base pipe 402. When in the closed position, as shown in FIG. 4, the sliding sleeve 126 occludes the corresponding flow ports 128 and prevents fluid communication between the interior of the base pipe 402 and the surrounding formation 104. When moved to the open position, as shown in FIG. 5, the flow ports 128 become exposed and fluid communication between the interior of the base pipe 402 and the surrounding formation 104 is facilitated either for injection or production operations.

Figure 5:
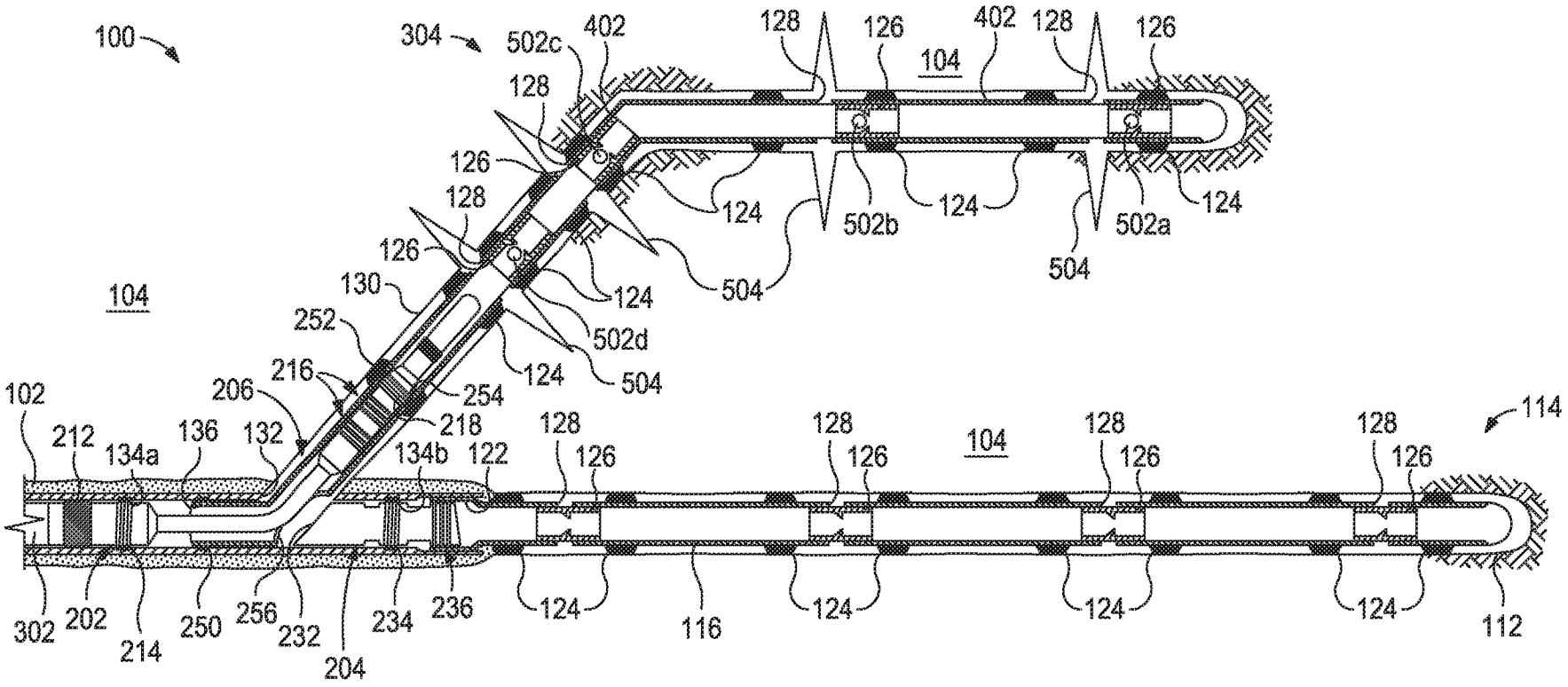
FIG. 5 is a cross-sectional side view of the well system during a hydraulic fracturing operation performed in the lateral wellbore.

FIG. 5 is a cross-sectional side view of the well system 100 during a hydraulic fracturing operation undertaken in the lateral wellbore 130. As described above, the junction isolation tool 202 and the junction support tool 206 are mechanically anchored and supported in the lateral wellbore 130. At this point, the transition joint packer 252 of the junction support tool 206 and the wellbore isolation devices 124 of the lateral completion assembly 304 may then be actuated and otherwise radially expanded into sealing engagement with the inner wall of the lateral wellbore 130. Doing so will isolate the lateral wellbore 130 from the parent wellbore 102, divide the annulus in the lateral wellbore 130 into various production zones, provide additional support to the junction support tool 206, and reduce sand mitigation into the junction between the parent and lateral wellbores 102, 130.

With the transition joint packer 252 actuated and the radial seals 216 of the junction isolation tool 202 sealingly engaged against the inner radial surface of the junction support tool 206, the lateral wellbore 130 will be fluidly isolated from the parent wellbore 102 and will provide the required pressure rating capabilities for hydraulic fracturing operations. At this point, a plurality of wellbore projectiles 502, shown as wellbore projectiles 502*a*, 502*b*, 502*c*, and 502*d*, may be dropped from the surface location and pumped into the lateral wellbore 130 via the conveyance 302 and the junction isolation tool 202. In the illustrated embodiment, the wellbore projectiles 502*a-d* are depicted as balls. In other embodiments, however, the wellbore projectiles 502*a-d* may comprise wellbore darts or plugs, without departing from the scope of the disclosure.

The first wellbore projectile 502*a* may be sized and otherwise configured to bypass uphole sliding sleeves 126 and land on the last sliding sleeve 126 of the lateral completion assembly 304 located at the toe of the lateral wellbore 130. Once properly landed on the last sliding sleeve 126, pressure within the conveyance 302 may be increased, which correspondingly increases the fluid pressure within the base pipe 402 of the lateral completion assembly 304 via the junction isolation tool 202. The increase in pressure may act on the first wellbore projectile 502*a*, which provides a mechanical seal against the last sliding sleeve 126 and thereby moves the last sliding sleeve 126 from the closed position, as shown in FIG. 4, to the open position, as shown in FIG. 5. As indicated above, moving the sliding sleeve 126 to the open position exposes the underlying flow ports 128 and facilitates fluid communication between the base pipe 402 and the surrounding formation 104. With the last sliding sleeve 126 in the open position, the fluid under pressure may be injected into the surrounding formation 104 via the exposed flow ports 128 and thereby hydraulically fracture the surrounding formation 104 and generate fractures 504 that extend radially outward from the lateral wellbore 130.

Once the first production zone (i.e., the production zone at the toe of the lateral wellbore 130) is fractured, the second wellbore projectile 502*b* may be conveyed to the lateral completion assembly 304 to locate and land on the penultimate sliding sleeve 126. Once properly landed on the penultimate sliding sleeve 126 and forming a mechanical seal therewith, pressure within the base pipe 402 may again be increased to move the penultimate sliding sleeve 126 from the closed position to the open position. The formation 104 surrounding the penultimate production zone may then be hydraulically fractured as described above to generate additional fractures 504. This process may be repeated with the third and fourth wellbore projectiles 502*c* and 502*d* to hydraulically fracture the remaining production zones in the lateral wellbore 130 and thereby generate corresponding fractures 504 in the surrounding formation 104 at those production zones.

With the hydraulic fracturing operations completed in the lateral wellbore 130 and the transition joint packer 252 still actuated, the junction isolation tool 202 may be detached from the junction support tool 206 and pulled back into parent wellbore 102. More specifically, an axial load in the uphole direction (i.e., to the left in FIG. 5) may be applied to the junction isolation tool 202 by pulling the conveyance 302 in the uphole direction toward the surface location. The axial load applied to the junction isolation tool 202 may be assumed by the upper latch coupling 214 and the releasable connection 218 of the junction isolation tool 202 as engaged with the upper latch profile 134*a* of the casing 106 and the profile 254 of the junction support tool 206, respectively. Upon assuming a predetermined axial load in the uphole direction, the upper latch coupling 214 and the releasable connection 218 may detach from the upper latch profile 134*a* and the profile 254, respectively, and thereby free the junction isolation tool 202 from the casing 106 and the junction support tool 206. At this point, the junction isolation tool 202 may be pulled back into the parent wellbore 102 while the junction support tool 206 remains fixed at the anchor coupling 250 and the transition joint packer 252.

Figure 6:
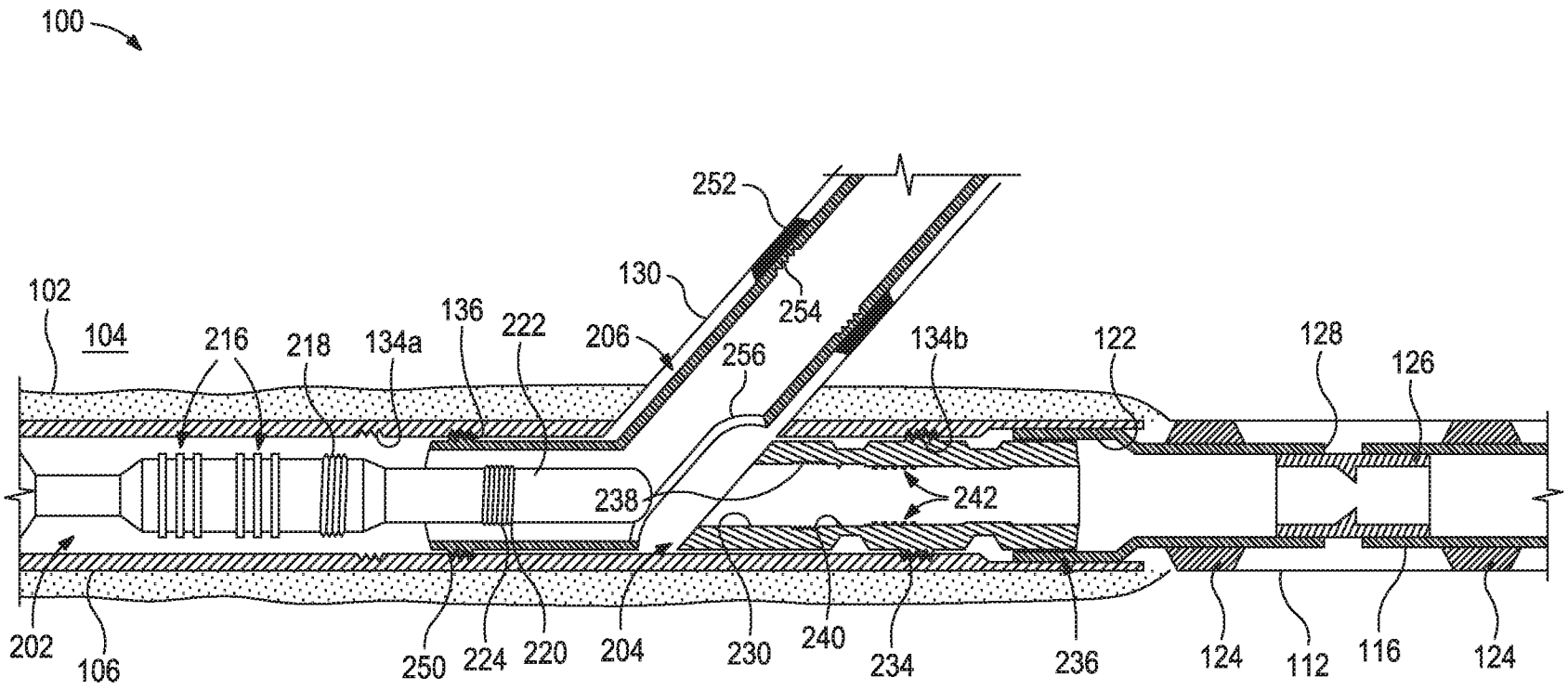
FIG. 6 is an enlarged cross-sectional side view of the well system with the junction isolation tool pulled back into the parent wellbore after being detached from the junction support tool.

FIG. 6 is an enlarged cross-sectional side view of the well system 100 with the junction isolation tool 202 detached from the junction support tool 206 and pulled back into the parent wellbore 102. At this point, the junction isolation tool 202 is prepared to be stung into and otherwise received by the inner bore 230 of the completion deflector 204. To accomplish this, the junction isolation tool 202 may be advanced axially downhole in the parent wellbore 102 and through the window 256 provided in the junction support tool 206. As indicated above, the stinger 222 may be advanced axially into the inner bore 230 of the completion deflector 204 and the inner seals 242 may sealingly engage the outer radial surface of the stinger 222. The stinger 222 may be advanced axially into the inner bore 230 until the stinger coupling 224 locates and engages the inner latch 238 provided in the inner bore 230 of the completion deflector 204.

In some embodiments, the radial shoulder 220 of the stinger 222 may engage the shearable shoulder 240 of the completion deflector 204 prior to coupling the stinger coupling 224 and the inner latch 238. Engaging the radial shoulder 220 on the shearable shoulder 240 may stop the axial progress of the stinger 222 into the inner bore 230, which may be sensed at the surface location and provide positive indication that the stinger 222 is received within the inner bore 230. In at least one embodiment, the shearable shoulder 240 may help centralize and align the junction isolation tool 202 within the inner bore 230. The shearable shoulder 240 may be sheared upon assuming a predetermined axial load applied through the junction isolation tool 202, thereby allowing the stinger 222 to advance further within the inner bore 230 so that the stinger coupling 224 can locate and engage the inner latch 238.

Figure 7:
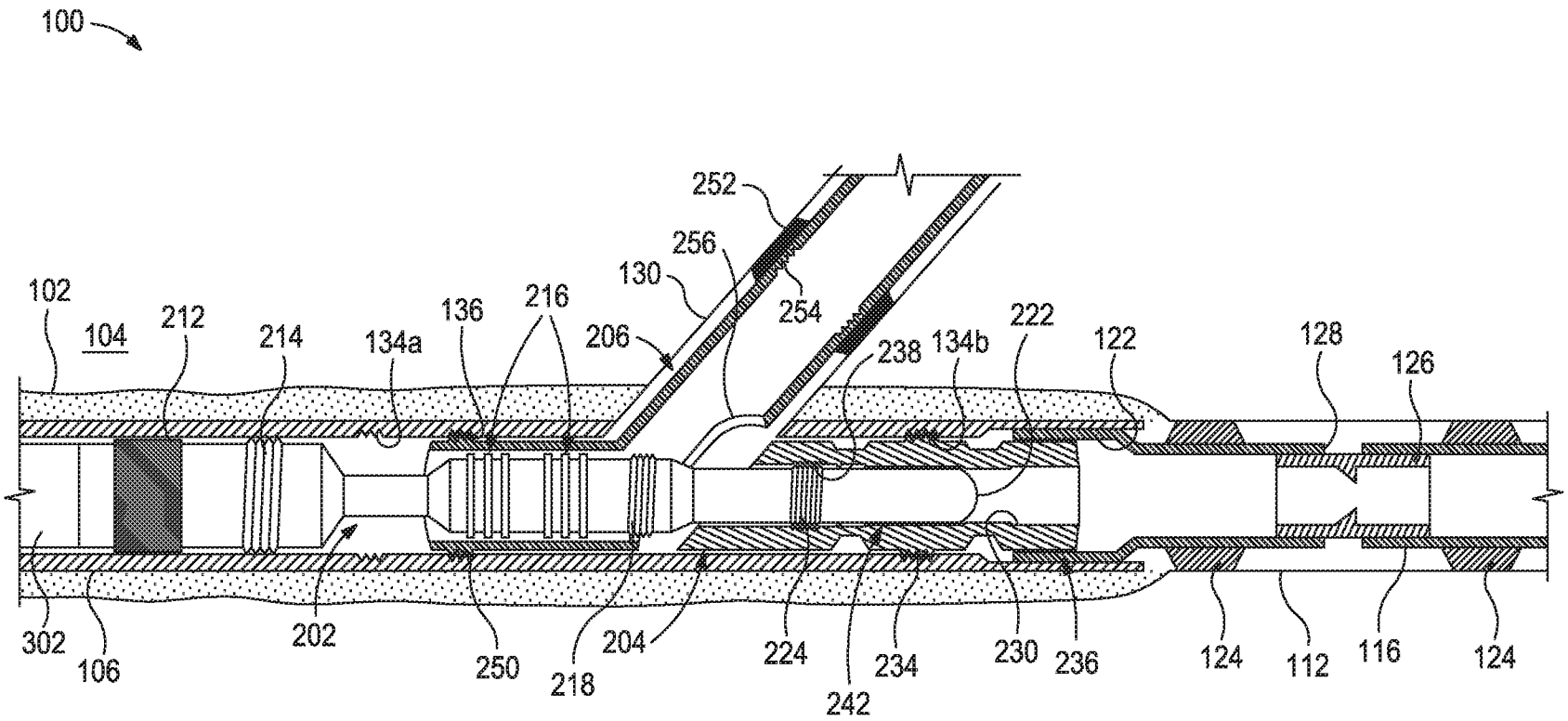
FIG. 7 is an enlarged cross-sectional side view of the well system depicting the junction isolation tool as coupled to the completion deflector.

FIG. 7 is an enlarged cross-sectional side view of the well system 100 depicting the junction isolation tool 202 as coupled to the completion deflector 204. Once the stinger coupling 224 locates and engages the inner latch 238, the retrievable packer 212 of the junction isolation tool 202 may be actuated to radially expand into sealing engagement with the inner wall of the casing 106. Actuating the retrievable packer 212 also serves to fix the junction isolation tool 202 in the parent wellbore 102 both axially and radially. With the retrievable packer 212 actuated and with the inner seals 242 of the completion deflector 204 sealingly engaged against the outer radial surface of the stinger 222, the lower wellbore portion 112 and the parent wellbore 102 may be fluidly isolated from the lateral wellbore 130. Moreover, the retrievable packer 212 and the inner seals 242 may provide the pressure rating capabilities required to undertake hydraulic fracturing operations within the lower wellbore portion 112.

Figure 8:
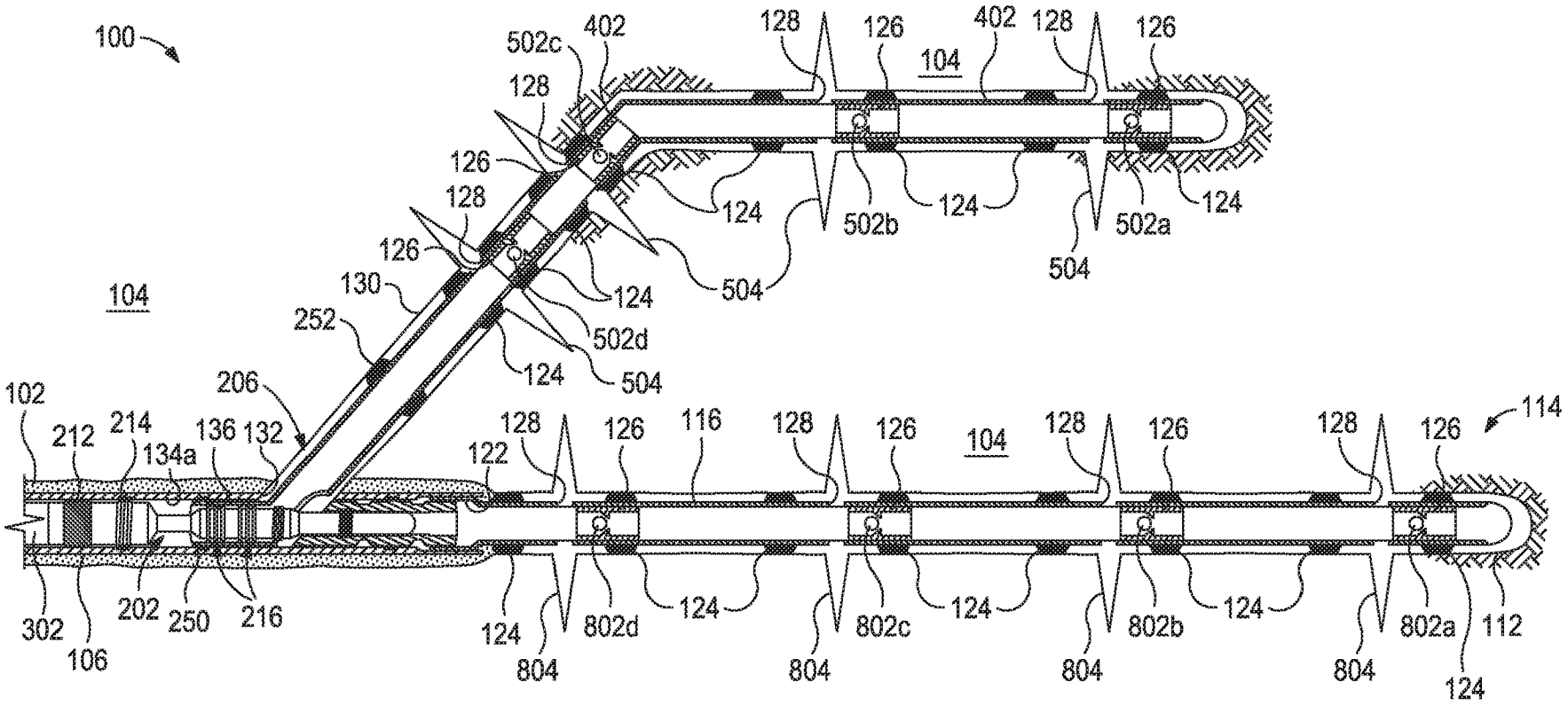
FIG. 8 is a cross-sectional side view of the well system during a hydraulic fracturing operation of the lower wellbore portion.

FIG. 8 is a cross-sectional side view of the well system 100 during a hydraulic fracturing operation of the lower wellbore portion 112, according to one or more embodiments. Hydraulically fracturing the lower wellbore portion 112 may be similar in some respects to the above-described process of hydraulically fracturing the lateral wellbore 130. More particularly, a plurality of wellbore projectiles 802, shown as wellbore projectiles 802*a*, 802*b*, 802*c*, and 802*d*, may be dropped from the surface location and pumped into the lower wellbore portion 112 via the conveyance 302 and the junction isolation tool 202. Similar to the wellbore projectiles 502*a-d*, the wellbore projectiles 802*a-d* may be balls, as illustrated, but could alternatively comprise wellbore darts or plugs.

The first wellbore projectile 802*a* may be sized and otherwise configured to bypass uphole sliding sleeves 126 and land on the last sliding sleeve 126 of the lower completion assembly 114 located at the toe of the lower wellbore portion 112. Once properly landed on the last sliding sleeve 126, pressure within the conveyance 302 may be increased, which correspondingly increases the fluid pressure within the liner 116 of the lower completion assembly 114 via the junction isolation tool 202. The increase in pressure may act on the first wellbore projectile 802*a*, which forms a mechanical seal with the last sliding sleeve and thereby moves the last sliding sleeve 126 from the closed position, as shown in FIG. 5, to the open position, as shown in FIG. 8. As indicated above, moving the sliding sleeve 126 to the open position exposes the underlying flow ports 128 and facilitates fluid communication between the liner 116 and the surrounding formation 104. With the last sliding sleeve 126 in the open position, pressurized fluid may be injected into the surrounding formation 104 to hydraulically fracture the formation 104 and thereby generate fractures 804 that extend radially outward from the lower wellbore portion 112.

Once the first production zone (i.e., the production zone at the toe of the lower wellbore portion 112) is fractured, the second wellbore projectile 802*b* may be conveyed to the lower completion assembly 114 to locate and land on the penultimate sliding sleeve 126. Once properly landed on the penultimate sliding sleeve 126 and forming a mechanical seal therewith, pressure within the liner 116 may again be increased to move the penultimate sliding sleeve 126 from the closed position to the open position. The formation 104 surrounding the penultimate production zone may then be hydraulically fractured as described above to generate additional fractures 804. This process may be repeated with the third and fourth wellbore projectiles 802*c,d* to hydraulically fracture the corresponding production zones and thereby resulting in corresponding fractures 804 formed in the surrounding formation 104.

With the hydraulic fracturing operations completed in the lower wellbore 112, the junction isolation tool 202 and the completion deflector 204 may be removed from the parent wellbore 102. This may be accomplished by deactivating (radially retracting) the retrievable packer 212 and then placing an axial load on the junction isolation tool 202 in the uphole direction (i.e., to the left in FIG. 8) via the conveyance 302. The axial load applied to the junction isolation tool 202 may be transferred to and assumed by the completion deflector 204 via the coupled engagement between the stinger coupling 224 and the inner latch 238. Upon assuming a predetermined axial load in the uphole direction, the lower latch coupling 234 of the completion deflector 204 may be configured to detach from the lower latch profile 134*b* provided on the casing 106 and thereby free the completion deflector 204 from the casing 106. At this point, the junction isolation tool 202 and the completion deflector 204 may be pulled through the window 256 of the junction support tool 206 and uphole to the surface location within the parent wellbore 102.

Figure 9:
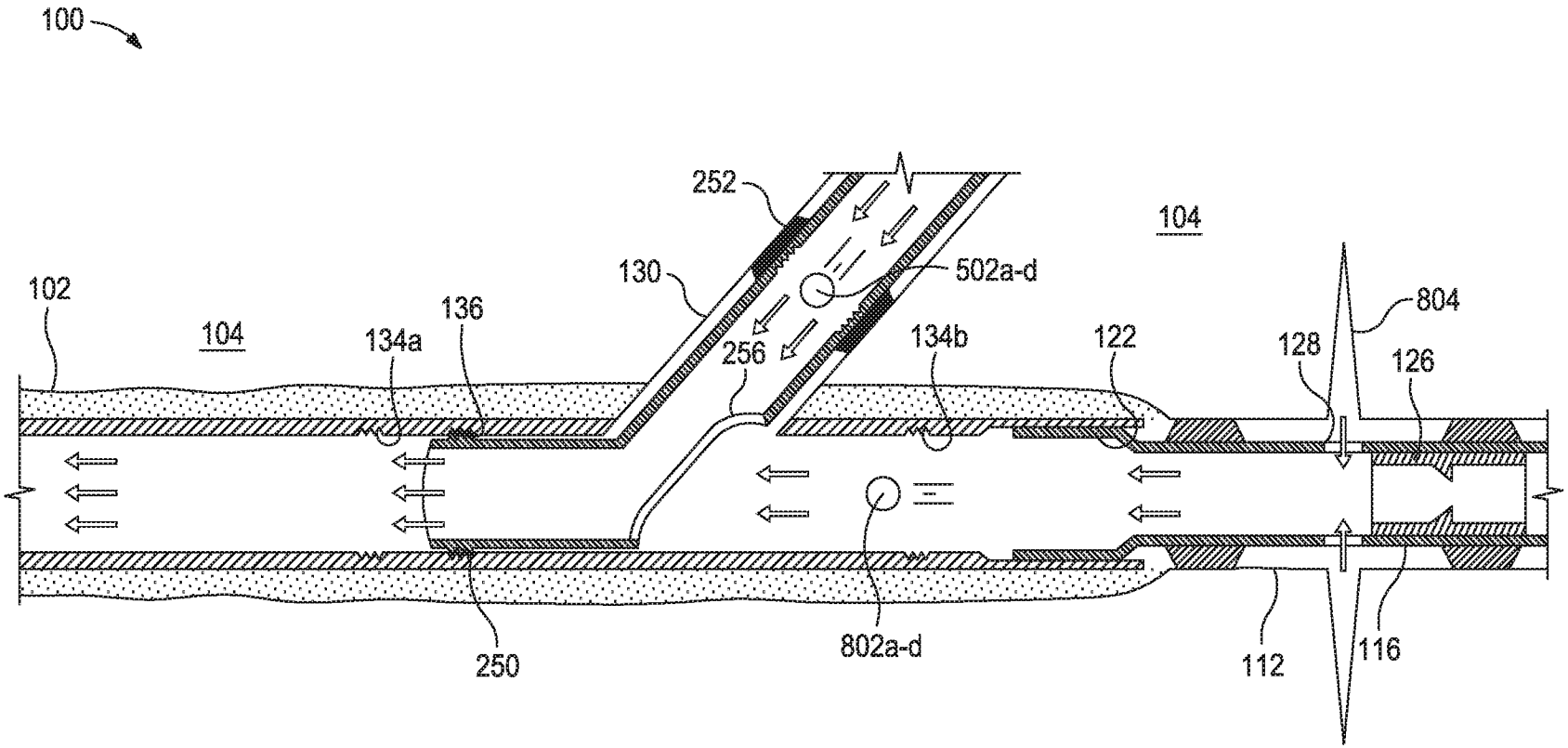
FIG. 9 is a cross-sectional side view of the well system with the junction isolation tool and the completion deflector removed following fracturing of the lower wellbore portion.

FIG. 9 is a cross-sectional side view of the well system 100 with the junction isolation tool 202 and the completion deflector 204 removed from the parent wellbore 102 following the hydraulic fracturing of the lower wellbore portion 112. As illustrated, following removal of the junction isolation tool 202 and the completion deflector 204, the junction support tool 206 remains secured within the well system 100 and provides a transition structure between the parent and lateral wellbores 102, 130. Moreover, removing the junction isolation tool 202 and the completion deflector 204 allows full-bore access into both the parent and lateral wellbores 102, 130 via the junction support tool 206 and the window 256 defined therein.

At this point, production operations can commence by extracting fluids from both the lower wellbore portion 112 and the lateral wellbore 130, as indicated by the flow arrows in FIG. 9. This results in a commingled flow of hydrocarbons from both the parent and lateral wellbores 102, 130 with a considerable increase in production due to the fractures 504 (FIGS. 5 and 8) created in the lateral wellbore 130 and the fractures 804 created in the lower wellbore portion 112. Moreover, once fluid production commences, the wellbore projectiles 502*a-d* and 802*a-d* may also be flowed back to the surface location via the parent wellbore 102.

Embodiments disclosed herein include:

A. A method that includes conveying a junction isolation tool, a junction support tool, a lateral completion assembly, and a completion deflector into a parent wellbore lined with casing, coupling the completion deflector to the casing, advancing the junction isolation tool, the junction support tool, and the lateral completion assembly at least partially into a lateral wellbore extending from the parent wellbore, coupling the junction isolation tool and the junction support tool to the casing, detaching the junction isolation tool from the casing and the junction support tool and retracting the junction isolation tool into the parent wellbore, advancing a stinger of the junction isolation tool into an inner bore of the completion deflector to couple the junction isolation tool to the completion deflector, and removing the completion deflector from the parent wellbore with the junction isolation tool.

B. A well system that includes a junction isolation tool conveyable into a parent wellbore lined with casing and connectable to the casing at an upper latch profile provided on the casing, a junction support tool detachably coupled to the junction isolation tool and coupled to a lateral completion assembly, and a completion deflector operatively coupled to the lateral completion assembly and connectable to the casing at a lower latch profile provided on the casing, wherein the lateral completion assembly is detachable from the completion deflector to allow the junction isolation tool, the junction support tool, and the lateral completion assembly to advance at least partially into a lateral wellbore extending from the parent wellbore, wherein the junction support tool is anchored to the casing with the lateral completion assembly positioned in the lateral wellbore, wherein the junction isolation tool is connectable to the completion deflector by advancing a stinger of the junction isolation tool into an inner bore of the completion deflector, and wherein the junction isolation tool detaches the completion deflector from the lower latch profile to remove the completion deflector from the parent wellbore.

Each of embodiments A and B may have one or more of the following additional elements in any combination: Element 1: wherein coupling the completion deflector to the casing comprises advancing a lower end of the completion deflector into a liner, wherein one or more radial seals are disposed about the lower end, sealingly engaging the radial seals against a polished bore receptacle defined on an inner surface of the liner, and mating a lower latch coupling of the completion deflector with a lower latch profile provided on the casing. Element 2: wherein coupling the junction isolation tool to the casing comprises mating an upper latch coupling of the junction isolation tool with an upper latch profile provided on an inner surface of the casing. Element 3: wherein mating the upper latch coupling with the upper latch profile comprises rotationally orienting the junction support tool such that a window of the junction support tool opens toward a deflector face of the completion deflector. Element 4: wherein detaching the junction isolation tool from the casing and the junction support tool comprises applying an axial load on the junction isolation tool in an uphole direction, disengaging the upper latch coupling from the upper latch profile as acted upon by the axial load, and disengaging a releasable connection of the junction isolation tool with a profile provided on an interior of the junction support tool as acted upon by the axial load. Element 5: wherein coupling the junction support tool to the casing comprises mating an anchor coupling of the junction support tool to a latch anchor provided on the casing. Element 6: wherein the lateral completion assembly includes a bullnose coupled to the completion deflector with a release mechanism, and wherein detaching the lateral completion assembly from the completion deflector comprises detaching the release mechanism. Element 7: wherein advancing the junction isolation tool, the junction support tool, and the lateral completion assembly into the lateral wellbore comprises engaging the bullnose against a deflector face of the completion deflector and thereby deflecting the bullnose into the lateral wellbore. Element 8: wherein advancing the stinger of the junction isolation tool into the inner bore of the completion deflector comprises advancing the junction isolation tool axially downhole in the parent wellbore and through a window defined in the junction support tool, sealingly engaging one or more inner seals provided within the inner bore on an outer radial surface of the stinger, and coupling the junction isolation tool to the completion deflector by mating a stinger coupling of the junction isolation tool with an inner latch provided in the inner bore of the completion deflector. Element 9: wherein removing the completion deflector from the parent wellbore with the junction isolation tool comprises deactivating the retrievable packer, placing an axial load on the junction isolation tool in an uphole direction, assuming the axial load with the completion deflector as coupled to the junction isolation tool, detaching the completion deflector from the casing by disengaging a lower latch coupling of the completion deflector from a lower latch profile provided on the casing, pulling the completion deflector through a window defined in the junction support tool. Element 10: wherein coupling the junction isolation tool and the junction support tool to the casing is followed by actuating a transition joint packer of the junction support tool to seal against an inner wall of the lateral wellbore, and hydraulically fracturing the lateral wellbore. Element 11: wherein advancing the stinger of the junction isolation tool into the inner bore of the completion deflector to couple the junction isolation tool to the completion deflector is followed by actuating a retrievable packer of the junction isolation tool to seal against an inner wall of the casing, and hydraulically fracturing a lower wellbore portion of the parent wellbore downhole from the completion deflector. Element 12: further comprising extracting fluids from formations surrounding a lower wellbore portion and the lateral wellbore and producing the fluids to a surface location.

Element 13: further comprising a retrievable packer disposed about the junction isolation tool to seal against an inner wall of the casing, and a transition joint packer disposed about the junction support tool to seal against an inner wall of the lateral wellbore. Element 14: further comprising one or more radial seals disposed about a lower end of the completion deflector to sealingly engage against a polished bore receptacle defined on an inner surface of a liner positioned within a lower wellbore portion extending from the parent wellbore. Element 15: further comprising a window defined in the junction support tool, wherein the window is aligned with a deflector face of the completion deflector when the junction isolation tool connects to the casing at the upper latch profile. Element 16: wherein the junction isolation tool is advanced through the window to receive the stinger of the junction isolation tool in the inner bore of the completion deflector. Element 17: further comprising one or more inner seals provided within the inner bore to sealingly engage an outer radial surface of the stinger, and a stinger coupling of the junction isolation tool that maters with an inner latch provided in the inner bore of the completion deflector to couple the junction isolation tool to the completion deflector. Element 18: wherein the lateral completion assembly includes a bullnose coupled to the completion deflector with a release mechanism, and the lateral completion assembly is detachable from the completion deflector by detaching the release mechanism.

By way of non-limiting example, exemplary combinations applicable to A and B include: Element 2 with Element 3; Element 2 with Element 4; Element 6 with Element 7; and Element 15 with Element 16.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A method, comprising:

conveying a junction isolation tool, a junction support tool, a lateral completion assembly, and a completion deflector into a parent wellbore lined with casing;

coupling the completion deflector to the casing;

advancing the junction isolation tool, the junction support tool, and the lateral completion assembly at least partially into a lateral wellbore extending from the parent wellbore;

coupling the junction isolation tool and the junction support tool to the casing;

detaching the junction isolation tool from the casing and the junction support tool and retracting the junction isolation tool into the parent wellbore;

advancing a stinger of the junction isolation tool into an inner bore of the completion deflector to couple the junction isolation tool to the completion deflector; and removing the completion deflector from the parent wellbore with the junction isolation tool.

2. The method of claim 1, wherein coupling the completion deflector to the casing comprises:

advancing a lower end of the completion deflector into a liner, wherein one or more radial seals are disposed about the lower end;

sealingly engaging the radial seals against a polished bore receptacle defined on an inner surface of the liner; and mating a lower latch coupling of the completion deflector with a lower latch profile provided on the casing.

3. The method of claim 1, wherein coupling the junction isolation tool to the casing comprises mating an upper latch coupling of the junction isolation tool with an upper latch profile provided on an inner surface of the casing.

4. The method of claim 3, wherein mating the upper latch coupling with the upper latch profile comprises rotationally orienting the junction support tool such that a window of the junction support tool opens toward a deflector face of the completion deflector.

5. The method of claim 3, wherein detaching the junction isolation tool from the casing and the junction support tool comprises:

applying an axial load on the junction isolation tool in an uphole direction;

disengaging the upper latch coupling from the upper latch profile as acted upon by the axial load; and disengaging a releasable connection of the junction isolation tool with a profile provided on an interior of the junction support tool as acted upon by the axial load.

6. The method of claim 1, wherein coupling the junction support tool to the casing comprises mating an anchor coupling of the junction support tool to a latch anchor provided on the casing.

7. The method of claim 1, wherein the lateral completion assembly includes a bullnose coupled to the completion deflector with a release mechanism, and wherein detaching the lateral completion assembly from the completion deflector comprises detaching the release mechanism.

8. The method of claim 7, wherein advancing the junction isolation tool, the junction support tool, and the lateral completion assembly into the lateral wellbore comprises engaging the bullnose against a deflector face of the completion deflector and thereby deflecting the bullnose into the lateral wellbore.

9. The method of claim 1, wherein advancing the stinger of the junction isolation tool into the inner bore of the completion deflector comprises:

advancing the junction isolation tool axially downhole in the parent wellbore and through a window defined in the junction support tool;

sealingly engaging one or more inner seals provided within the inner bore on an outer radial surface of the stinger; and coupling the junction isolation tool to the completion deflector by mating a stinger coupling of the junction isolation tool with an inner latch provided in the inner bore of the completion deflector.

10. The method of claim 1, wherein removing the completion deflector from the parent wellbore with the junction isolation tool comprises:

deactivating the retrievable packer;

placing an axial load on the junction isolation tool in an uphole direction;

assuming the axial load with the completion deflector as coupled to the junction isolation tool;

detaching the completion deflector from the casing by disengaging a lower latch coupling of the completion deflector from a lower latch profile provided on the casing; and pulling the completion deflector through a window defined in the junction support tool.

11. The method of claim 1, wherein coupling the junction isolation tool and the junction support tool to the casing is followed by:

actuating a transition joint packer of the junction support tool to seal against an inner wall of the lateral wellbore; and hydraulically fracturing the lateral wellbore.

12. The method of claim 1, wherein advancing the stinger of the junction isolation tool into the inner bore of the completion deflector to couple the junction isolation tool to the completion deflector is followed by:

actuating a retrievable packer of the junction isolation tool to seal against an inner wall of the casing; and hydraulically fracturing a lower wellbore portion of the parent wellbore downhole from the completion deflector.

13. The method of claim 1, further comprising extracting fluids from formations surrounding a lower wellbore portion and the lateral wellbore and producing the fluids to a surface location.

14. A well system, comprising:

a junction isolation tool conveyable into a parent wellbore lined with casing and connectable to the casing at an upper latch profile provided on the casing;

a junction support tool detachably coupled to the junction isolation tool and coupled to a lateral completion assembly; and a completion deflector operatively coupled to the lateral completion assembly and connectable to the casing at a lower latch profile provided on the casing, wherein the lateral completion assembly is detachable from the completion deflector to allow the junction isolation tool, the junction support tool, and the lateral completion assembly to advance at least partially into a lateral wellbore extending from the parent wellbore, wherein the junction support tool is anchored to the casing with the lateral completion assembly positioned in the lateral wellbore, wherein the junction isolation tool is connectable to the completion deflector by advancing a stinger of the junction isolation tool into an inner bore of the completion deflector, and wherein the junction isolation tool detaches the completion deflector from the lower latch profile to remove the completion deflector from the parent wellbore.

15. The well system of claim 14, further comprising:

a retrievable packer disposed about the junction isolation tool to seal against an inner wall of the casing; and a transition joint packer disposed about the junction support tool to seal against an inner wall of the lateral wellbore.

16. The well system of claim 14, further comprising one or more radial seals disposed about a lower end of the completion deflector to sealingly engage against a polished bore receptacle defined on an inner surface of a liner positioned within a lower wellbore portion extending from the parent wellbore.

17. The well system of claim 14, further comprising a window defined in the junction support tool, wherein the window is aligned with a deflector face of the completion deflector when the junction isolation tool connects to the casing at the upper latch profile.

18. The well system of claim 17, wherein the junction isolation tool is advanced through the window to receive the stinger of the junction isolation tool in the inner bore of the completion deflector.

19. The well system of claim 14, further comprising:

one or more inner seals provided within the inner bore to sealingly engage an outer radial surface of the stinger; and a stinger coupling of the junction isolation tool that maters with an inner latch provided in the inner bore of the completion deflector to couple the junction isolation tool to the completion deflector.

20. The well system of claim 14, wherein the lateral completion assembly includes a bullnose coupled to the completion deflector with a release mechanism, and the lateral completion assembly is detachable from the completion deflector by detaching the release mechanism.

* * * * *